US006158496A

United States Patent [19]

Lonardi et al.

[11] Patent Number: 6,158,496

[45] Date of Patent: Dec. 12, 2000

[54] CONTINUOUS CASTING DIE

[75] Inventors: Emile Lonardi, Bascharage; Radomir Andonov, Mamer; Hubert Stomp, Howald; Rudy Petry, Muensbach; Norbert Kaell, Differdange; Guy Klepper, Dudelange, all of Luxembourg

[73] Assignee: Paul Wurth S.A., Luxembourg, Luxembourg

[21] Appl. No.: 09/068,917

[22] PCT Filed: Nov. 29, 1996

[86] PCT No.: PCT/EP96/05284

§ 371 Date: Jul. 30, 1998

§ 102(e) Date: Jul. 30, 1998

[87] PCT Pub. No.: WO97/23317

PCT Pub. Date: Jul. 3, 1997

[30] Foreign Application Priority Data

Dec. 22, 1995 [LU] Luxembourg ..... 88689

[51] Int. Cl.[7] ..... B22D 11/041; B22D 11/051; B22D 11/055

[52] U.S. Cl. ..... 164/416; 164/418; 164/443

[58] Field of Search ..... 164/443, 416, 164/418, 459, 478, 485

[56] References Cited

U.S. PATENT DOCUMENTS

| | | | |
|---|---|---|---|
| 2,835,940 | 5/1958 | Wieland . | |
| 4,523,623 | 6/1985 | Holleis et al. . | |
| 5,642,769 | 7/1997 | Thone et al. | 164/418 |

FOREIGN PATENT DOCUMENTS

| | | | |
|---|---|---|---|
| 1450175 | 11/1966 | France . | |
| 1479815 | 7/1967 | France . | |
| 747977 | 10/1944 | Germany . | |
| 3235673 | 4/1983 | Germany . | |
| 679380 | 2/1992 | Switzerland . | |
| 1035843 | 8/1982 | United Kingdom | 164/418 |
| 2091607 | 8/1982 | United Kingdom . | |
| WO 95/03904 | 2/1995 | WIPO . | |

OTHER PUBLICATIONS

JP Abstract for JP Appl. No. 59–185551 (vol. 9, #46, Feb. 1985).

JP Abstract for JP Appl. No. 58–15940 (vol. 8, #270, Dec. 1984).

*Primary Examiner*—Kuang Y. Lin

*Attorney, Agent, or Firm*—Smith, Gambrell & Russell, LLP

[57] ABSTRACT

A continuous casting die has a casting channel (10) formed by molding plates (12) and a self-carrying frame construction with lateral openings into which the molding plates (12) can be slidingly inserted perpendicularly to the casting channel. The frame construction preferably has a top frame (14) with a passage (16) which is slightly larger than the cross-section of the casting channel (10) at the entrance of the casting die, a bottom frame (18) with a passage (20) which is slightly larger than the cross-section of the casting channel (10) at the exit of the casting die, and corner sections (22) which link the top frame (14) to the bottom frame (18). The lateral passages are delimited at their sides by the two corner sections, above by the top frame (14) and below by the bottom frame (18).

27 Claims, 9 Drawing Sheets

CONTINUOUS CASTING DIE

FIELD OF THE INVENTION

The invention relates to a mould for continuous casting of metals, especially steel.

BACKGROUND OF THE INVENTION

Both tube moulds and plate moulds are used in continuous casters. Tube moulds are used mainly for casting billet, bloom and round strands. Plate moulds, on the other hand, have established themselves above all for slab casting.

Conventional tube moulds have a one-piece copper tube which forms a casting channel of square, rectangular or circular cross-section. This copper tube is surrounded by a water conducting jacket and installed in a cooling box.

In the case of conventional plate moulds, a casting channel of rectangular cross section is formed by four mould plates made of copper. Each of these four mould plates is fixed to a support plate and has a separate cooling box which is supplied with cooling water via flexible pipes. A heavy supporting frame is placed around the support plates. Means of applying pressure, such as, for example, hydraulic cylinders or threaded spindles, are mounted on this supporting frame and the support plates and press the four mould plates rigidly against one another. Such a plate mould is described for example in the patent application DE 3235673. A plate mould is known from the patent application U.S. Pat. No. 2,835,940, wherein the mould plates are twisted by means of threaded rods and engage with each other via a "groove and tongue"-system at their longitudinal edges.

Plate moulds of the described types are mostly used for casting strands of rectangular cross-section with a length-to-width ratio greater than four to one. However, they can also be used instead of tube moulds for casting billet and bloom strands. Here, plate moulds have the advantage over tube moulds that mould plates are simpler and cheaper to manufacture than a one-piece casting tube. Moreover, worn mould plates can be more easily reworked than worn tube moulds. On the other hand, tube moulds for billet and bloom strands need neither a heavy supporting frame nor support plates to support the mould plates and are therefore much lighter and above all more compact than comparable plate moulds.

A plate mould with a squared cross-section is known from the patent application FR 1479815. In this plate mould, the casting channel is formed by mould plates and special corner sections. Mould plates and corner sections are assembled via a tongue and groove arrangement and placed as a unit into a tubular metallic housing. This housing may be joined to an oscillating device.

Both tube moulds and plate moulds are oscillated in the direction of casting. These oscillations of the mould may for instance have a frequency of up to 500 oscillations per minute and an amplitude of over 10 mm, whereby the oscillating mass can amount to several tonnes. Oscillating the mould therefore requires a very high power consumption. It follows from this that it is desirable to keep the oscillating mass as small as possible.

A conventional oscillator comprises an oscillating table on which the entire tube mould or plate mould is disposed. International patent application WO 95/03904 however describes a tube mould with an integral oscillator. Only the casting tube is supported by the oscillator and is joined to an external housing via a lower and an upper elastically deformable sealing membrane in such a way that it is able to oscillate in the housing along the axis of casting. Around the casting tube, the sealing membranes seal a ring-shaped chamber for a coolant. In the case of this tube mould, the mass of the parts to be oscillated, and thereby the power consumption, is greatly reduced.

In the patent application CH 679380 is described an additional cooling section of a multistage mould. This additional cooling section comprises four corner sections, which guide the already hardened branch. Plate coolers are arranged between the corner sections, said plate coolers which are being elastically pressed against the lateral faces of the branch in order to warrant an optimal additional cooling of the hardened branch.

The basis for the present application is the object of providing a compact mould with reworkable mould plates for the casting of, in particular, billet and bloom strands which can be excellently converted into a mould with an integral oscillator.

SUMMARY OF THE INVENTION

This object is achieved in that the mould plates are slidably fitted perpendicular to the casting channel into lateral openings of a self-supporting framework. The self-supporting framework forms a self-supporting skeleton, so to speak, which assembles the mould plates into a compact, mechanically stable unit and absorbs most of the forces. Heavy support plates and heavy bracing means can be dispensed with, with the result that the mould according to the invention enables substantial weight savings to be achieved compared with conventional plate moulds. It should be emphasised in particular that the casting tube, which is designed as a mechanically stable, self-supporting unit, can without difficulty be designed as an oscillating element in a mould with an integral oscillator.

The mould plates are guided in the lateral openings of the framework by their side faces in such a way that they are slidable inwards until their edges lie flush against each other and they form a closed channel. This enables the mould plates to be easily adjusted after their surface has been reworked. The framework comprises an upper frame with a passage opening which is slightly larger than the cross section of the casting channel at the entrance to the mould, a lower frame with a passage opening which is slightly larger than the cross section of the casting channel at the exit from the mould, and corner sections which join the upper frame to the lower frame. In this frame, each of the openings for the mould plates is bounded at the sides by two corner sections, at the top by the upper frame and at the bottom by the lower frame. The upper and lower frames form excellent points of application for an oscillator.

In a preferred construction, the side faces of the mould plates are laterally sealed against the side faces of the openings of the framework by a circumferential O-ring. By this means a sealed tubular element is formed, the mould plates nevertheless being easily readjustable after their surface has been reworked. This sealed tubular element, like the one-piece casting tube of a tube mould, can be directly surrounded by a coolant.

The present invention proposes several advantageous embodiments for the cooling of the casting channel.

In a first embodiment, each of the lateral openings of the framework is outwardly closed by a cover in such a way that at least one cooling chamber is formed between the fitted mould plate and the cover. This is an extremely simple means of forming cooling chambers behind the mould plates. The cover fitted into the opening and fixed to the framework gives the framework additional stability.

The covers fitted into the framework advantageously rest by their faces on the mould plates, with means of applying pressure acting directly on the mould plate via the covers. Alternatively, however, the cover can be bolted onto the mould plate, at least one sealed cooling chamber thus being formed between the mould plate and the cover, and it is no longer necessary to seal the mould plate in the framework.

In a further design, an external jacket which abuts in a sealed manner against an upper and a lower frame of the framework is placed over the framework, a cooling chamber thereby being formed between the fitted mould plates and the external jacket. In this embodiment the cooling chamber is therefore arranged in an annular fashion around the casting tube assembled from mould plates. In this way fewer connections for the coolant are required and the framework is surrounded by the coolant. A further advantage is that the external jacket can be removed and installed at little cost, the mould plates thus being easily accessible.

The mould according to the invention advantageously comprises an oscillator and a supporting structure, with the supporting structure bearing the oscillator and the oscillator bearing the framework. This oscillator is advantageously designed as a hydraulic oscillator with an oscillating lever, the oscillating lever being mounted in an articulated manner in the supporting structure and joined in an articulated manner to the framework. In this embodiment of the mould, the high mechanical stability of the framework according to the invention is particularly advantageous.

If the mould forms a curved casting channel, the oscillator advantageously includes a guide member which is flexibly joined to the supporting structure and the framework, a straight line through the articulations between the oscillating lever and the framework and between the oscillating lever and the supporting structure on the one hand and a straight line through the articulations between the guide member and the framework and between the guide member and the supporting structure on the other hand intersecting in the centre of curvature of the curved casting strand. By this means the casting tube oscillates approximately along the curved axis of the casting strand.

The present invention also proposes several approaches to the design of the coolant inflows and outflows.

In a first embodiment, the framework is installed in a housing and is joined to it by an upper and a lower elastically deformable sealing membrane in such a way that a ring-shaped coolant chamber is delimited around the framework, the framework being able to oscillate in the housing along the axis of casting. This ring-shaped chamber is advantageously divided by an internal sealing device into a lower and an upper ring-shaped collector joined respectively to a coolant feed line and a coolant return line. The framework with mould plates fitted and sealed may then, for example, be surrounded by a water conducting jacket which all around the framework delimits an annular gap which joins the lower collector to the upper one. In the case of the described design of the framework structure with inserted covers or a fitted external jacket, the cooling chambers of the mould plates are joined to the lower annular collector by at least one lower opening and to the upper annular collector by at least one upper opening.

The aforementioned elastically deformable sealing membranes are advantageously made of an elastomeric material with intermediate reinforcing layers. They may each have a circumferential bulge which projects into the ring-shaped chamber and has a beneficial effect on the life of the membranes.

In a further embodiment of the cooling system, the cooling chambers of the mould plates are supplied with coolant via flexible feed and return connections. These flexible feed and return connections advantageously comprise swivel-mounted tubes which permit small axial and radial movements of the casting tube oscillating along a curved path. Alternatively, however, rolling-bellows connectors made of an elastomeric material can be used, which are advantageously fitted parallel (or tangential) to the direction of oscillation. Both constructions of the flexible feed and return connections are characterised by a low space requirement and optimum absorption of the oscillations.

The flexible feed and return connections may, however, also comprise a ring-shaped flexible collector which surrounds the framework. A flexible connector of this kind is formed for instance by two ring-shaped membranes placed one above the other. It may advantageously be divided by partitions into several segments. It is worth emphasising that with this design, the masses of water to be moved by the oscillator are much smaller. The partitions greatly improve the water distribution between the individual mould plates.

In a further embodiment of the cooling system, the cooling chambers of the mould plates are supplied with cooling water via the swivel joints of the oscillating lever. In this embodiment no flexible connecting elements for coolant supply need be provided. This of course permits an extremely compact design and reduces the risk of a pipe fracture.

The mould plates advantageously have cooling fins in the cooling chambers. The cooling chambers may however also be formed by internal channels in the body of the mould plate. The framework can also be provided with internal coolant channels.

BRIEF DESCRIPTION OF THE DRAWINGS

Example embodiments of the invention will now be described, with reference to the accompanying drawings.

DETAILED DESCRIPTION OF THE DRAWINGS

Figure 1:
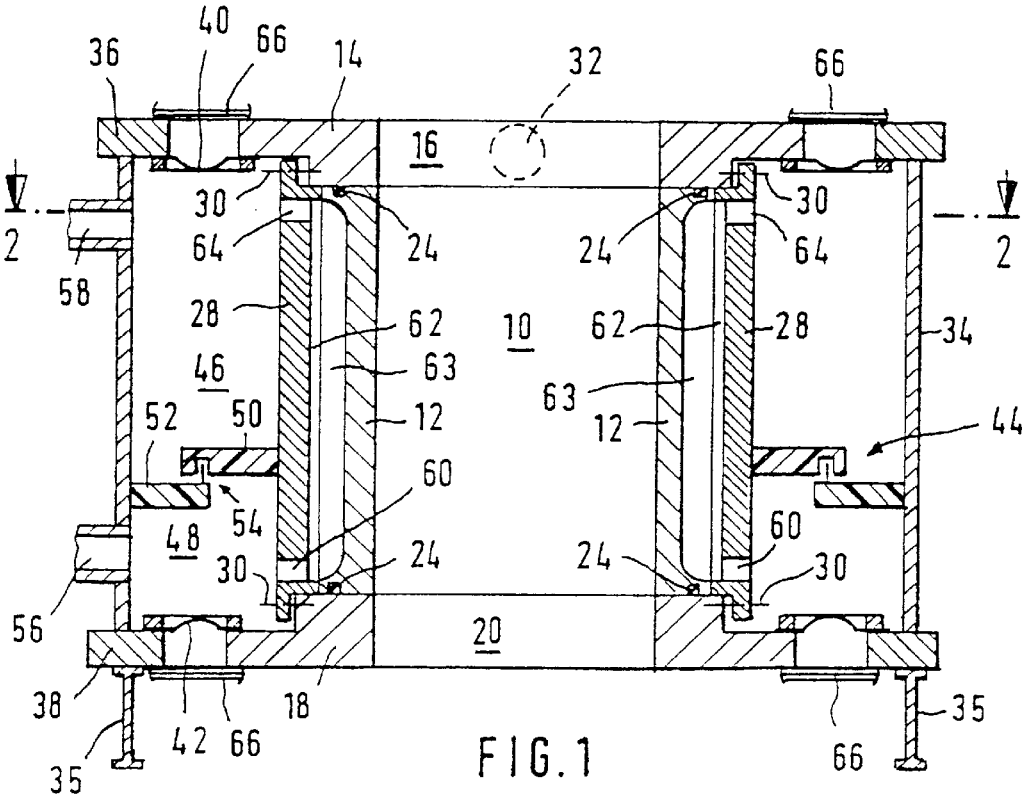
FIG. 1 shows a longitudinal section through a first embodiment of a mould according to the invention.
Figure 2:
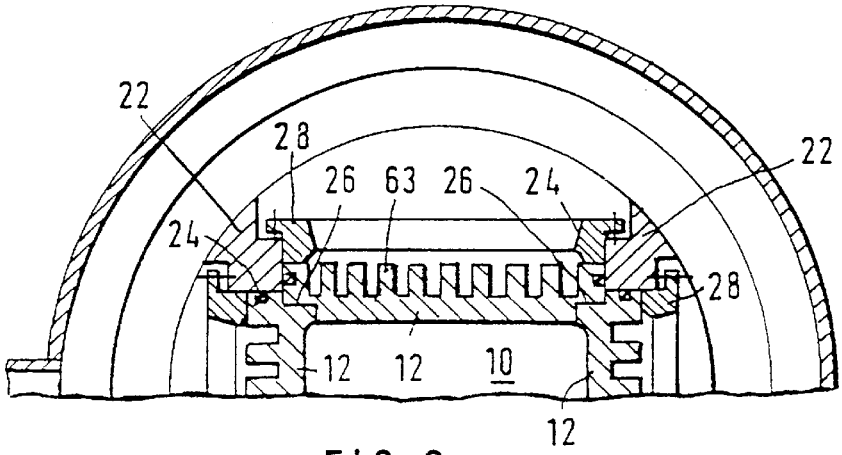
FIG. 2 shows a cross-section along the section plane 2—2 of FIG. 1; only one half of the mould is shown.

FIGS. 1 and 2 show a first embodiment of a mould for a continuous caster according to the invention. The mould has a casting channel 10 of rectangular cross-section which is formed by four mould plates 12. These mould plates 12 are made of, for example, pure copper or a copper alloy and therefore have no great inherent stability. According to the invention, the four mould plates 12 are fitted into lateral openings of a self-supporting, mechanically rigid framework.

This self-supporting framework substantially comprises the following parts:

- an upper steel frame 14 with a passage opening 16 which is slightly larger than the cross-section of the casting channel 10 at the entrance to the mould,
- a lower steel frame 18 with a passage opening 20 which is slightly larger than the cross-section of the casting channel 10 at the exit from the mould,
- four steel corner sections 22 which join the upper frame 14 to the lower frame 18.

Each of the four lateral openings into which the four mould plates are fitted is therefore bounded at the sides by two corner sections 18, at the top by the upper frame 14 and at the bottom by the lower frame 18. It will be apparent from FIGS. 1 and 2 that the tightly fitted mould plates 12 butt against the framework with their four side faces in such a way that they are slidable perpendicular to the casting channel in the openings of the framework until their edges ultimately lie flush against one another and they form a closed casting channel. This enables the mould plates 12 to be easily adjusted after their surface has been reworked.

The side faces of each of the four mould plates 12 are laterally sealed against the side faces of the openings of the framework by means of a circumferential O-ring 24. It will be apparent from FIG. 2 that the adjacent side edges of the mould plates 12 engage positively with each other and form a joint 26 of "Z"-shaped cross-section. In this way the pressure application surface between the plates is enlarged and the joints 26 lie in the casting channel 10 outside the corners.

Each of the lateral openings is provided with a cover 28, the face of which rests on the corresponding mould plate 12. Appropriate means of applying pressure, schematically indicated by the axis lines 30, are mounted on the framework and press the covers 28 by their faces against the mould plates 12. By this means the four mould plates 12, which are slidable in the openings of the framework, are pressed firmly together to form the casting channel 10. Appropriate means of applying pressure are, for example, threaded bolts or clamps with pressure springs and prestressed threaded bolts.

The framework with fitted mould plates 12 and cover 28 forms a mechanically stable, self-supporting casting tube which, as described in WO 95/03904, is advantageously supported by an oscillating lever of an hydraulic oscillator. Neither the oscillator nor the oscillating lever are shown in FIGS. 1 and 2. In FIG. 1, however, a journal pin 32 for the oscillating lever is visible on the upper frame 14. The oscillating lever itself is illustrated in, for example, FIGS. 15–18.

The casting tube assembled as described is surrounded by an external cooling box 34, which is provided with an upper ring flange 36 and a lower ring flange 38. This cooling box 34 is supported by a fixed supporting structure which in FIG. 1 is indicated for example by the beam 35. The upper ring flange 36 is joined by means of an elastically deformable ring-shaped sealing membrane 40 to the upper frame 14. In the same way the lower ring flange 38 is joined by means of an elastically deformable ring-shaped sealing membrane 42 to the lower frame 18. A ring-shaped chamber is thus delimited around the casting tube, the casting tube being able to oscillate in the housing along the axis of casting. The reference numeral 44 denotes a sealing device which divides this ring-shaped chamber into an upper collector 46 and a lower collector 48. This sealing device comprises, for example, a segmented inner ring-plate 50 on the casting tube and an outer ring plate 52 on the housing 34, which engage with each other by means of a ring-shaped labyrinth seal 54 in such a way that the inner annular plate 50 is movable relative to the outer annular plate 52. However, the sealing device 44 could also comprise a ring-shaped flexible sealing membrane. The lower collector 48 is supplied with cooling water via a feed pipe 56. This cooling water flows via feed slits 60 in the covers 28 into cooling chambers 62 which are formed between the covers 28 and the mould plates 12. In the cooling chambers 62, the mould plates are advantageously provided with cooling fins 63 which greatly increase the heat transfer surface. Return slits 64 in the covers 28 link the cooling chambers 62 to the upper collector 46. The cooling water ultimately leaves the mould via a return pipe 58.

The elastic sealing membranes 40, 42 are advantageously made of an elastomeric material with reinforcing plies such as, for example, fabric and/or steel wire plies. In their central region a circumferential bulge is shown which projects into the annular chamber. This circumferential bulge is pressed outwards by the pressurised cooling water in the annular chamber, the circumferential bulge causing compressive stresses to arise in the membrane. These compressive stresses counteract the tensile stresses in the membrane caused by the oscillatory movement of the casting tube, which has a beneficial effect on the life of the membrane. The reference numerals 66 denote bar-shaped guide elements which transmit horizontal tension or compression forces to the housing 34 but do not restrict the oscillatory freedom of the casting tube.

Figure 3:
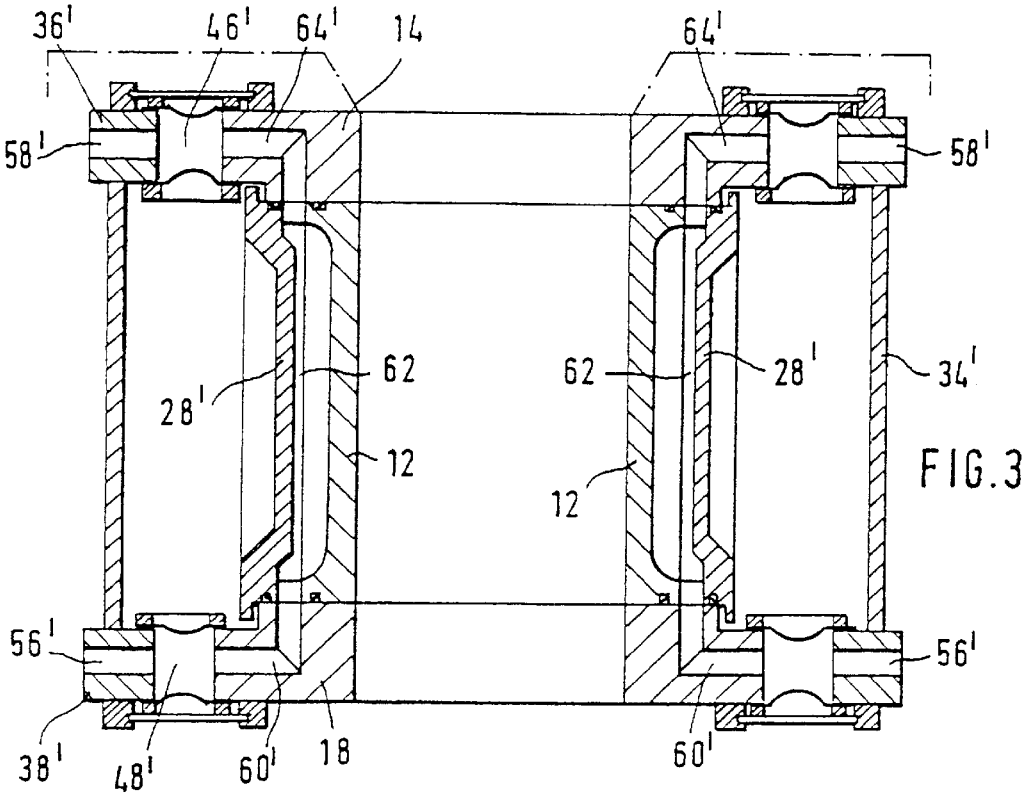
FIG. 3 shows a longitudinal section through a second embodiment of a mould according to the invention.
Figure 4:
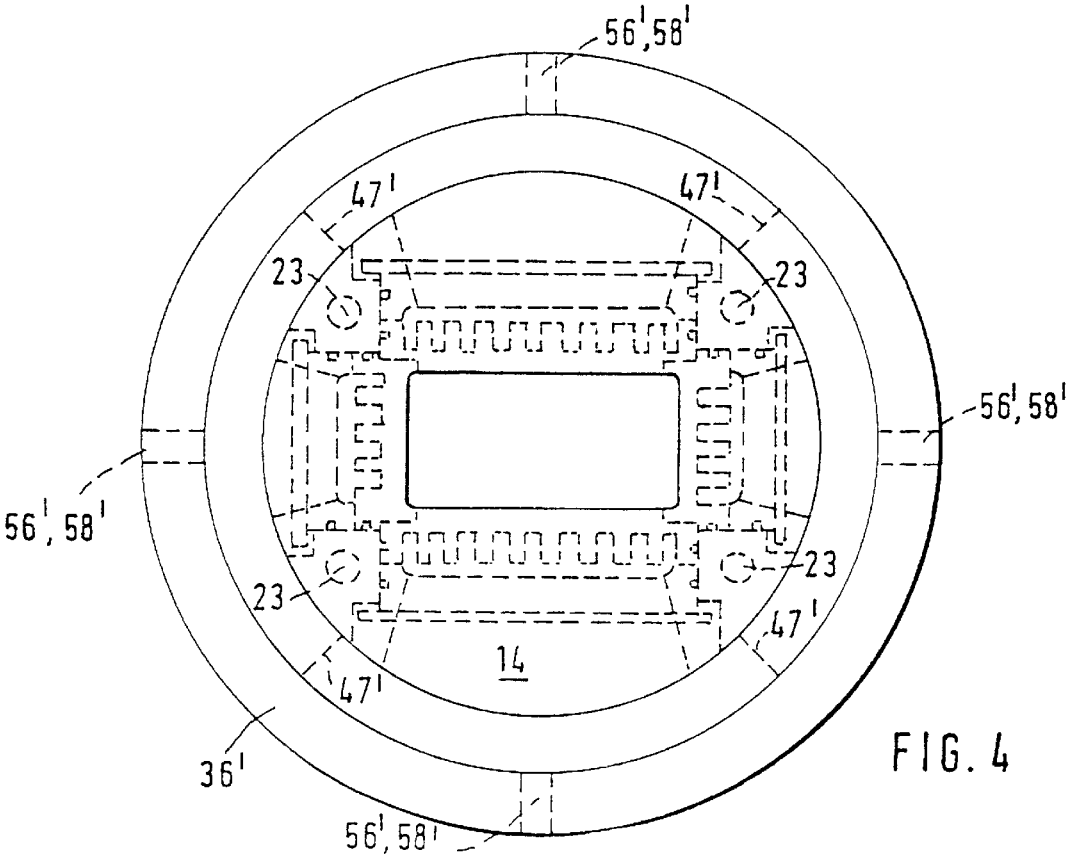
FIG. 4 shows a plan view of the mould shown in FIG. 3.

FIGS. 3 and 4 illustrate a further embodiment of a mould for a continuous caster according to the invention. This embodiment differs essentially from the embodiment illustrated by FIGS. 1 and 2 in the following respects. The upper and lower collectors 46, 48 shown in FIG. 1 are designed as flexible ring-shaped collectors 46', 48'. The latter are mounted between the upper frame 14 and an upper ring flange 36' of the housing 34' and, respectively, between the lower frame 18 and a lower ring flange 38' of the housing 34'. Channels 60' in the lower frame 18 link the lower flexible ring-shaped collector 48' to the cooling chambers 62. The covers 28' provide cooling-water-tight sealing of the cooling chambers 62 of the mould plates 12. Channels 64' in the upper frame 14 link the upper flexible ring-shaped collector 46' to the cooling chambers 62. The flexible ring-shaped collectors 46', 48' are advantageously divided by four partitions 47' into four ring segments. Each of these ring segments corresponds to one of the four cooling chambers 62 and is joined to a separate feed channel 56' in the lower ring flange 38' or, as applicable, by a separate return channel 58' in the upper ring flange 38'. In this way a uniform distribution of the cooling water to the four cooling chambers 62 is achieved. The flexible ring-shaped collectors 46', 48' are advantageously each formed by two ring-shaped membranes placed one above the other. These membranes may, for example, be of the same design as the previously described elastic sealing membranes 40, 42 shown in FIG. 1. As indicated in FIG. 3, the membranes may be sprayed from outside with a coolant, which has a beneficial effect on their life. It will be apparent from FIG. 4 that the corner sections are provided with internal cooling channels 23 through which the cooling water also flows.

Figure 5:
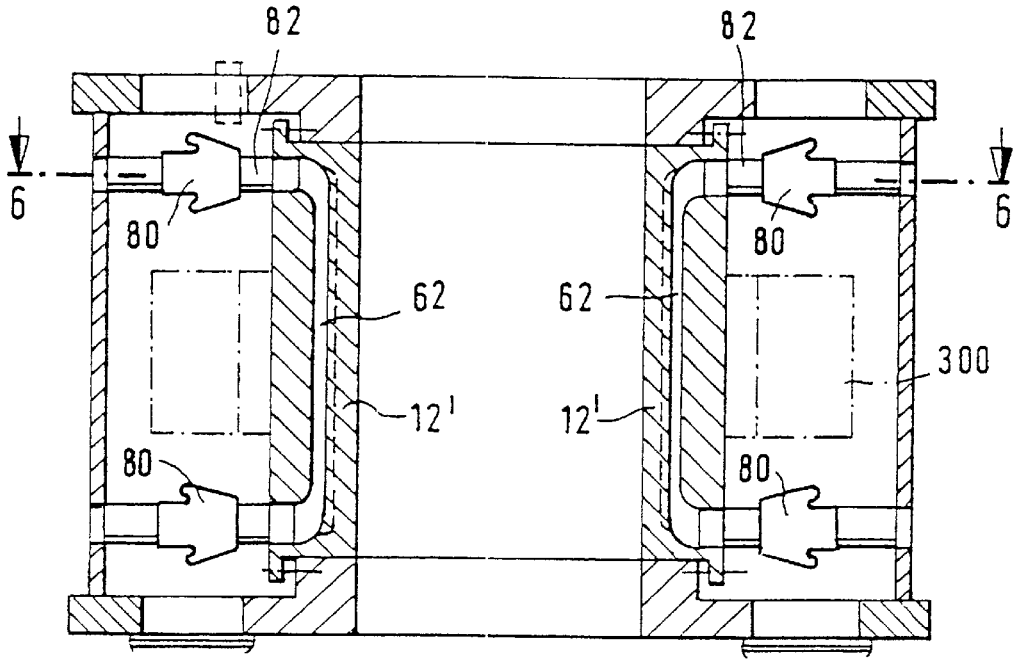
FIG. 5 shows a longitudinal section through a further embodiment of a mould according to the invention.
Figure 6:
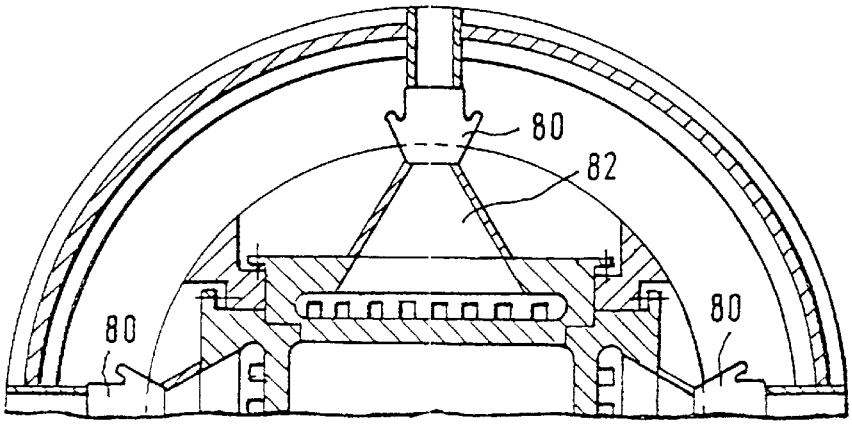
FIG. 6 shows a cross-section along the section plane 6—6 of FIG. 5; only one half of the mould is shown.

FIGS. 5 and 6 illustrate a further embodiment of a mould for a continuous caster according to the invention. This embodiment differs essentially from the embodiment illustrated by FIGS. 3 and 4 in the following respects. The flexible ring-shaped collectors 46', 48' are replaced by flexible connectors 80, which each run directly into the cooling chambers 62 via a funnel-shaped connecting piece 82. These flexible connecting pieces are advantageously designed as rolling-bellows connectors made of an elastomeric material.

Figure 11:
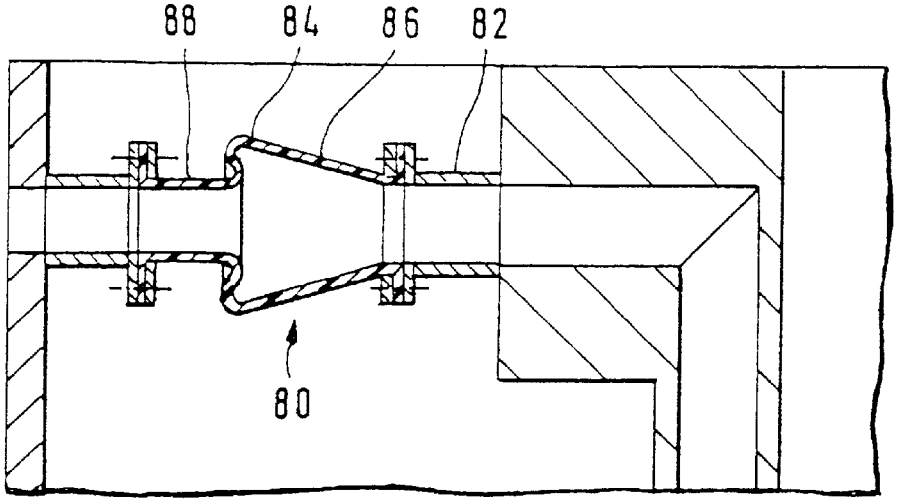
FIGS. 11 and 12 show a section through rolling-bellows connectors according to the invention.
Figure 12:
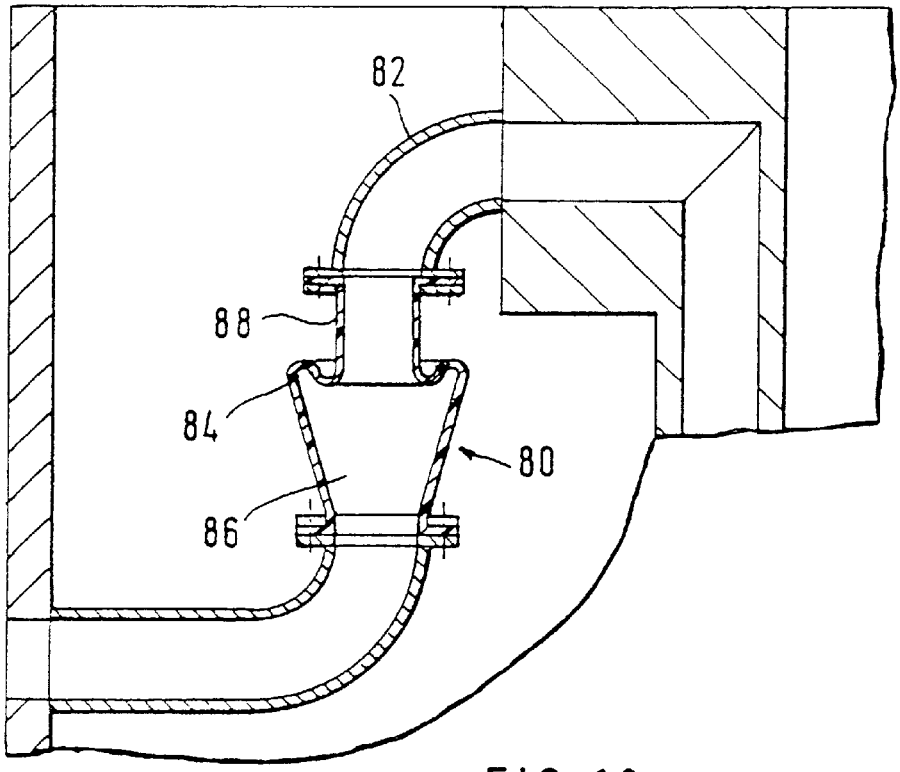

These rolling-bellows connectors 80 are illustrated in detail in FIGS. 11 and 12. A ring-shaped bellows 84 which joins a funnel-shaped element 86 to a cylindrical element 88 will be apparent. Vertical and horizontal movements of the connecting piece 82 are absorbed by a rolling motion of the ring-shaped bellows 84 on the cylindrical element 88. If the space available in the mould so permits, the rolling-bellows connectors 80 are preferably installed parallel to the direction of oscillation, as shown in FIG. 12.

Figure 13:
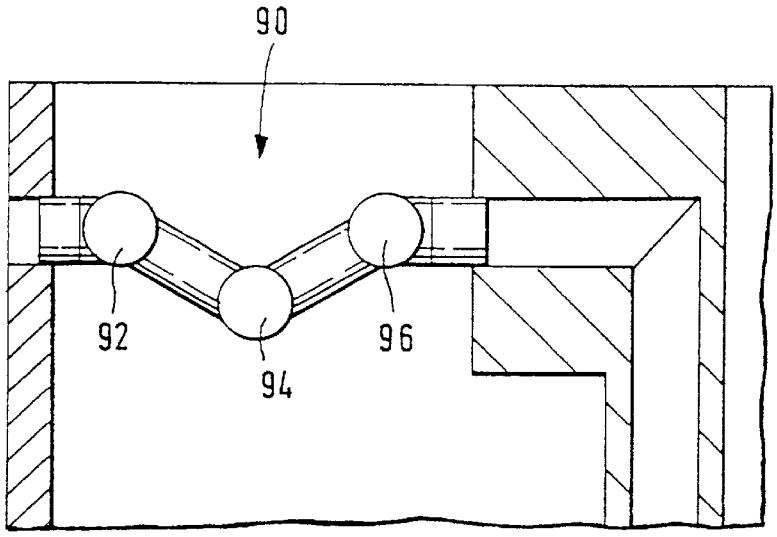
FIG. 13 shows a side view of a swivel joint according to the invention.
Figure 14:
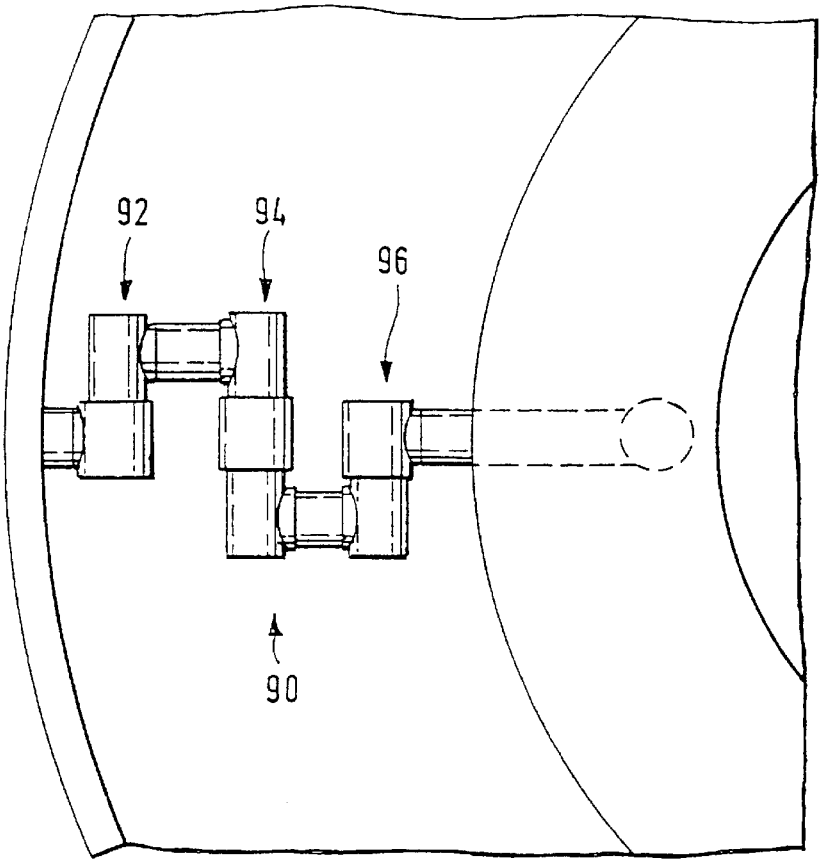
FIG. 14 shows a plan view of the swivel joint shown in FIG. 13.

FIGS. 13 and 14 illustrate an interesting alternative to the rolling-bellows connectors 80. In these figures the oscillating casting tube is connected by means of swivel-mounted tubes 90 to a cooling circuit. These swivel-mounted tubes 90 advantageously comprise three cylindrical swivel joints 92, 94, 96, which are arranged in such a way that they absorb both vertical and horizontal movements of the casting tube in the plane of FIG. 13. The casting tube can therefore oscillate along a curved path in the plane of FIG. 13.

It should also be emphasised that the mould plates 12' of the mould as illustrated in FIGS. 5 and 6 are of one-piece construction with an integral cooling chamber 62. These mould plates 12' can be fitted without sealants into the lateral openings of the framework. Here the cooling chamber 62 can be designed as an integrally cast hollow space with cooling fins, as illustrated in FIG. 6. However, it can also be formed by a plurality of bored channels.

Figure 7:
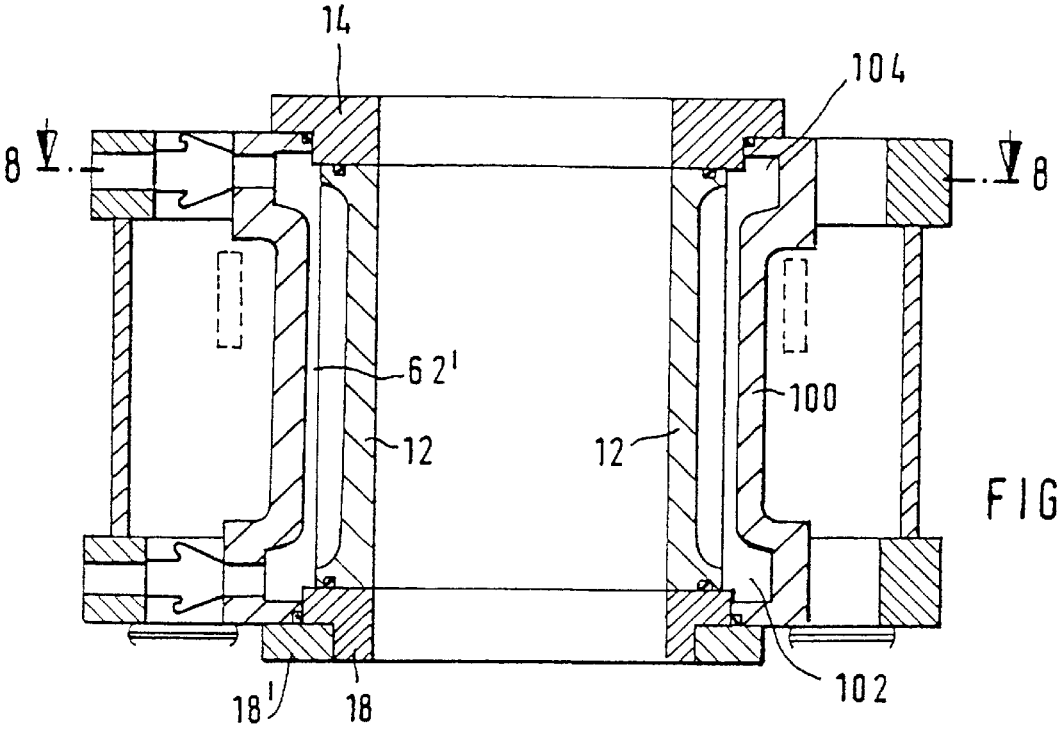
FIG. 7 shows a longitudinal section through a further embodiment of a mould according to the invention.
Figure 8:
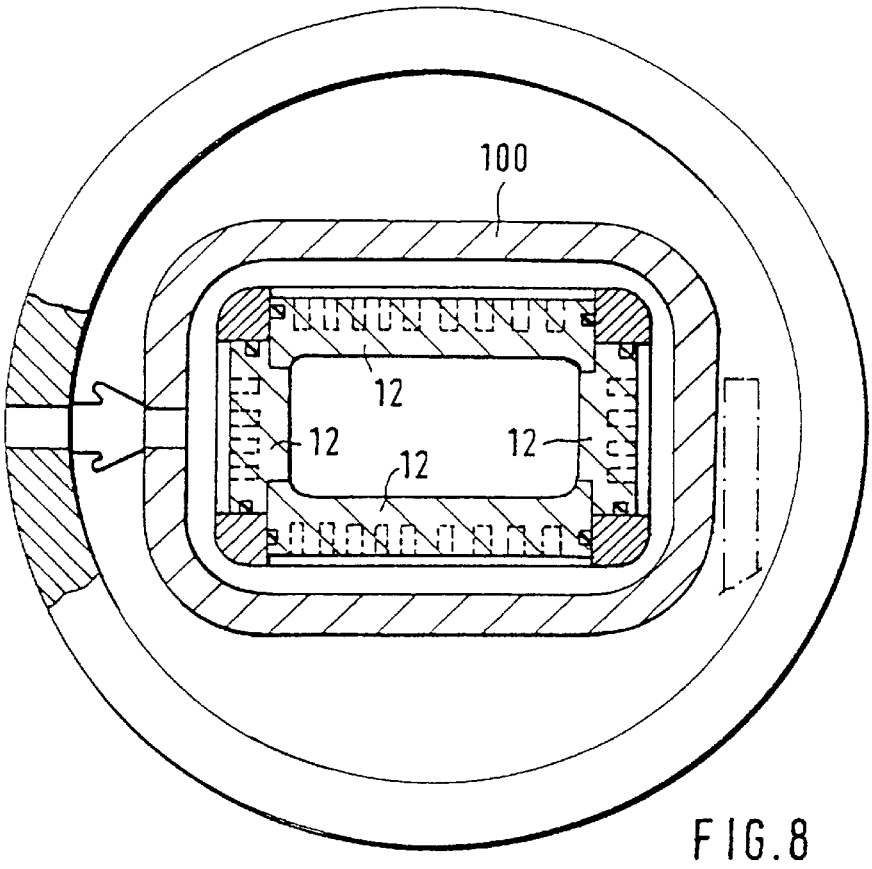
FIG. 8 shows a cross-section along the section plane 8—8 of FIG. 7.

FIGS. 7 and 8 illustrate a further embodiment of a mould for a continuous caster according to the invention. This embodiment differs essentially from the embodiment illustrated by FIGS. 5 and 6 in the following respects. The individual openings in the framework are not closed by separate covers; instead, an external jacket 100 is placed over the framework and butts in a sealed manner against the upper frame 14 and the lower frame 18 of the framework, a ring-shaped cooling chamber 62' being formed between the fitted mould plates 12 and the external jacket 100. This external jacket 100 is held against the lower frame 18 by, for example, a mounting flange 18' on its end face. A ring-shaped feed collector 102 and a ring-shaped return collector 104 are each formed by a ring-shaped bulge of the external jacket 100. A major advantage of this design with an external jacket 100 is that fewer connections are required for the coolant and the corner sections of the framework are also surrounded by the coolant. A further advantage is that the external jacket 100 can be removed and fitted without difficulty, so that the mould plates are easily accessible.

Figure 9:
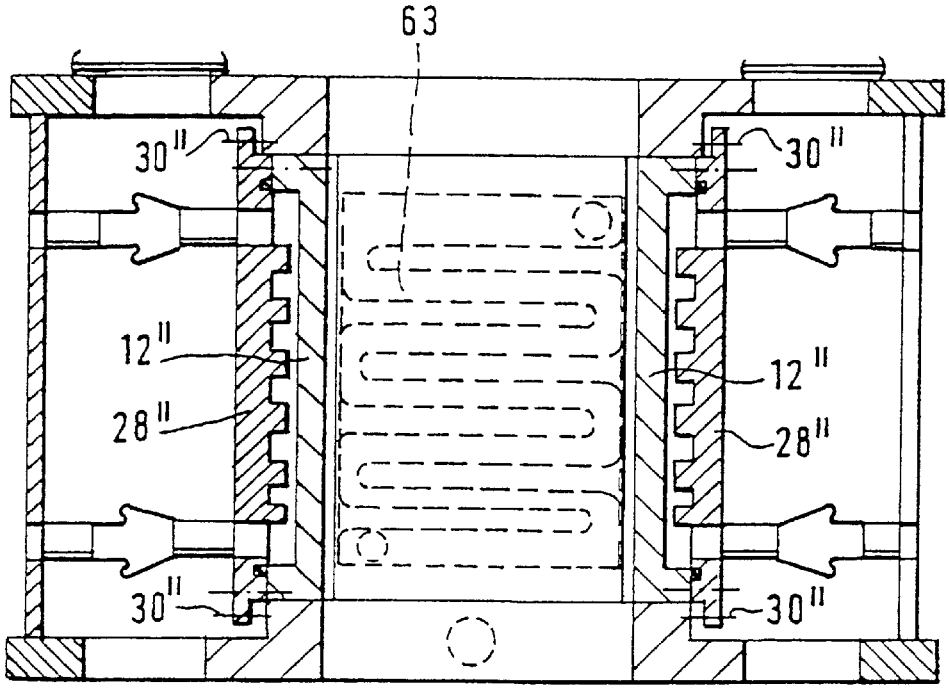
FIG. 9 shows a longitudinal section through a further embodiment of a mould according to the invention.

FIG. 9 shows a modification of the embodiment of the mould illustrated by FIG. 5. The mould plates 12" are not of one-piece construction but are closed in a sealed manner with a cover 28" on their face. The covers 28" may be provided with additional webs which in the cooling chamber delimit a serpentine channel 63. This channel 63 ensures that the mould plate is cooled as evenly as possible. In the case of large mould plates the webs also support the mould plate and thus prevent, if necessary, any bulging in the case of larger mould plates.

Figure 10:
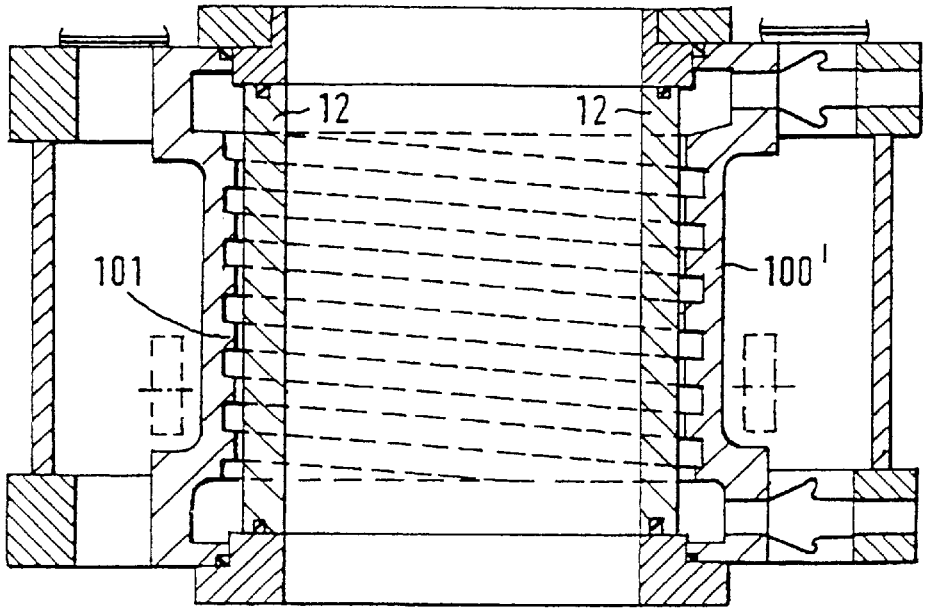
FIG. 10 shows a longitudinal section through a further embodiment of a mould according to the invention.

FIG. 10 illustrates a modification of the embodiment of the mould illustrated by FIG. 7. The external jacket 100' is provided with a serpentine web 101, which in the ring-shaped cooling chamber forms a serpentine channel for the cooling water. This channel also ensures that the mould plates 12 are cooled as evenly as possible.

Figure 15:
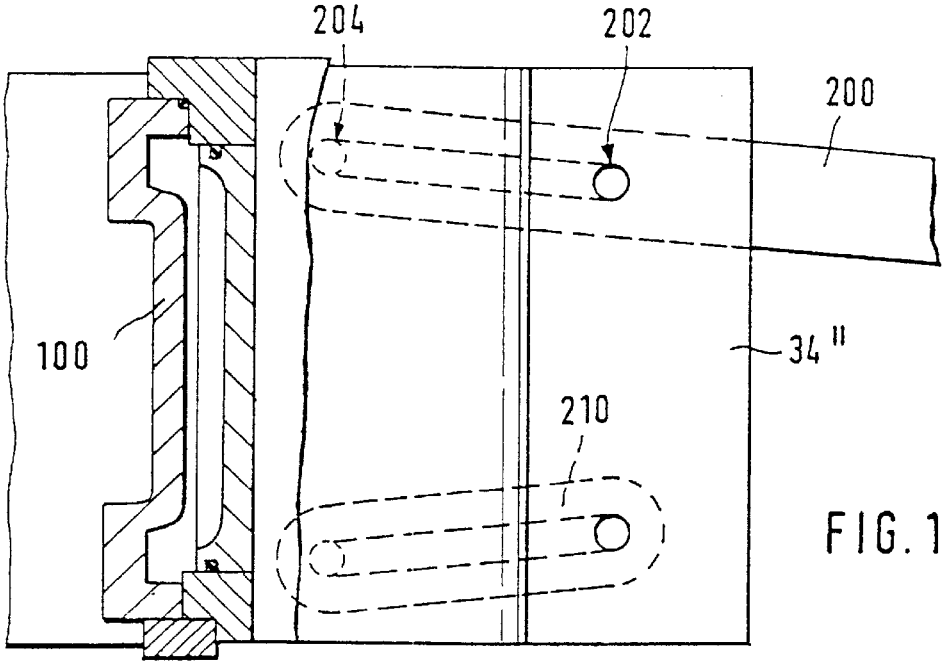
FIG. 15 shows a partial longitudinal section through a further embodiment of a mould according to the invention.
Figure 16:
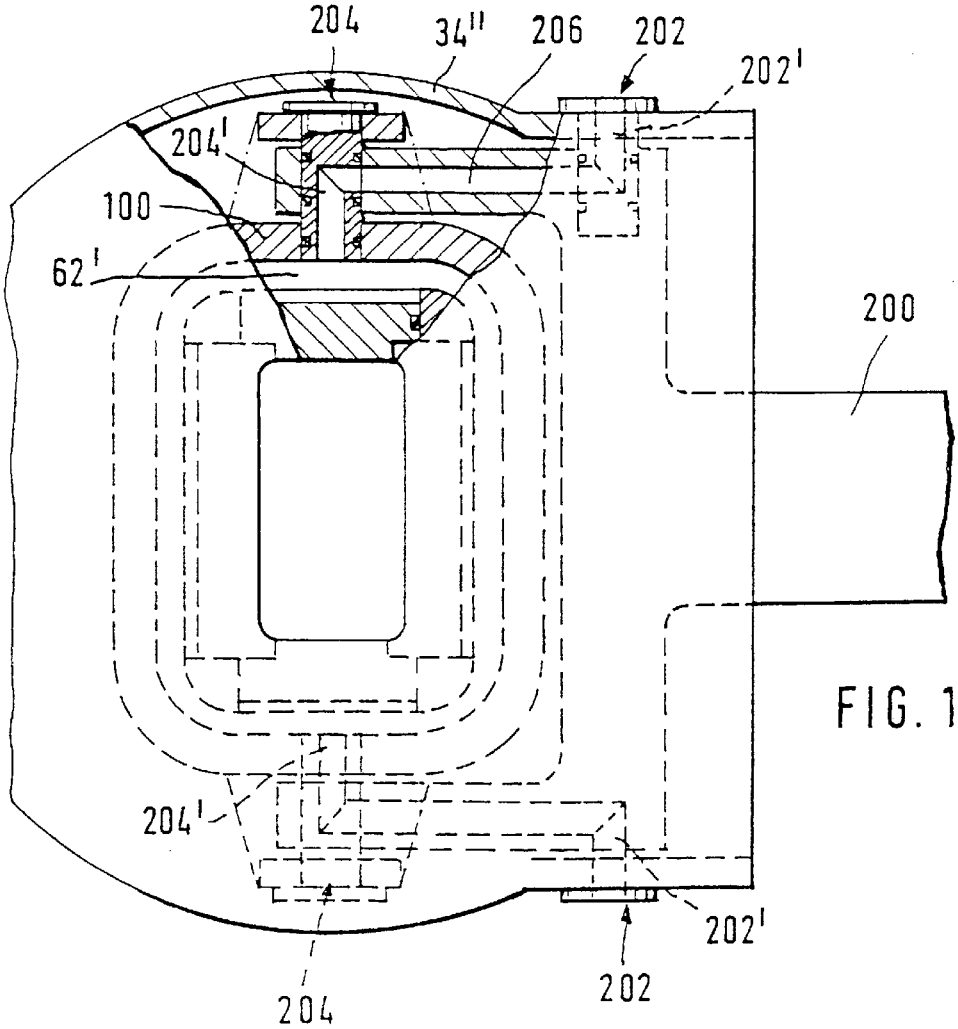
FIG. 16 shows a partial broken plan view of the mould shown in FIG. 15.

FIGS. 15 and 16 illustrate a particularly interesting embodiment of the mould cooling water supply system. The assembled casting tube is suspended in a forked oscillating lever 200. This oscillating lever 200 is provided with a first pair of swivel joints 202 which join the oscillating lever 200 to a fixed mould housing 34". A second pair of swivel joints 204 joins the oscillating lever 200 flexibly to the external jacket 100 of the casting tube. Fitted in both swivel joints 202 and swivel joints 204 are swivel-mounted tubes 202' and 204' respectively, which are joined together via an internal channel 206 in the oscillating lever 200. The swivel-mounted tubes 204' run into the cooling chamber 62'. By contrast, connected to the swivel-mounted tubes 202' fixed in a torsionally strong manner onto the housing 34" are coolant feed and/or return pipes. In the design illustrated by FIGS. 15 and 16, only return pipes are connected to the two swivel tubes 202'. Feeding of cooling water is accomplished by the same principle via two guide members which are also flexibly joined to the fixed mould housing on the one hand and the external jacket 100 of the casting tube on the other.

It remains to be mentioned that in the case of a curved casting channel the lines passing through the articulations of the oscillating lever 200 and the lines passing through the articulations of the guide member 210 are required to intersect in the centre of curvature of the curved casting strand.

Figure 17:
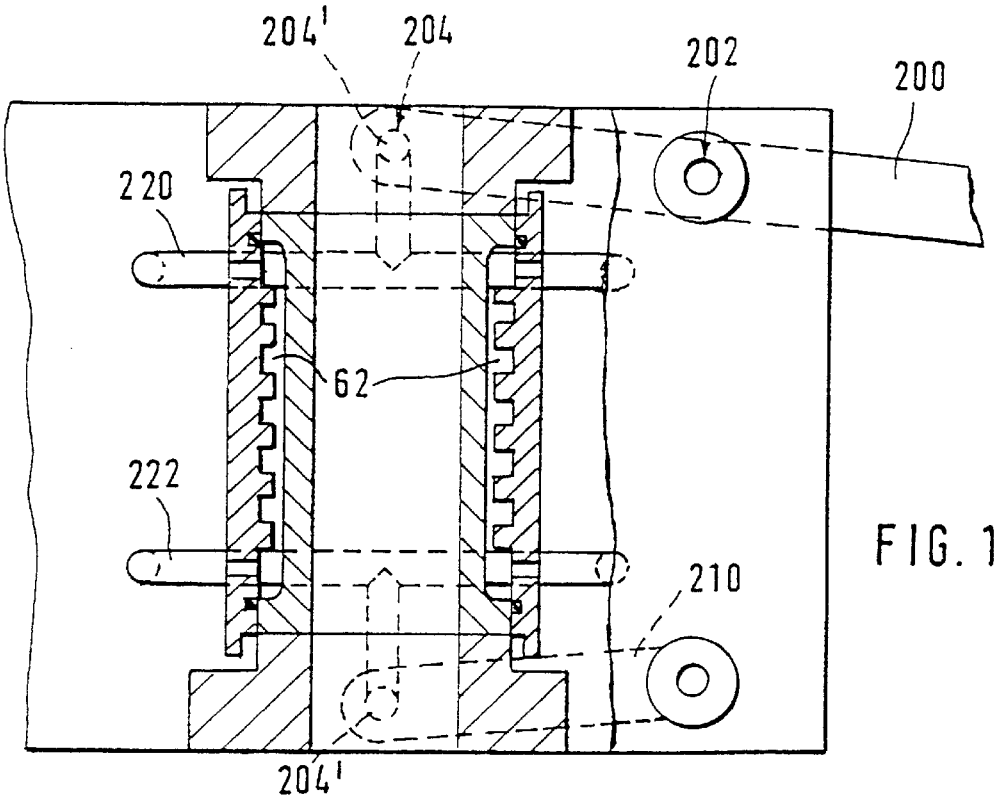
FIG. 17 shows a partial longitudinal section through a further design of a mould according to the invention.
Figure 18:
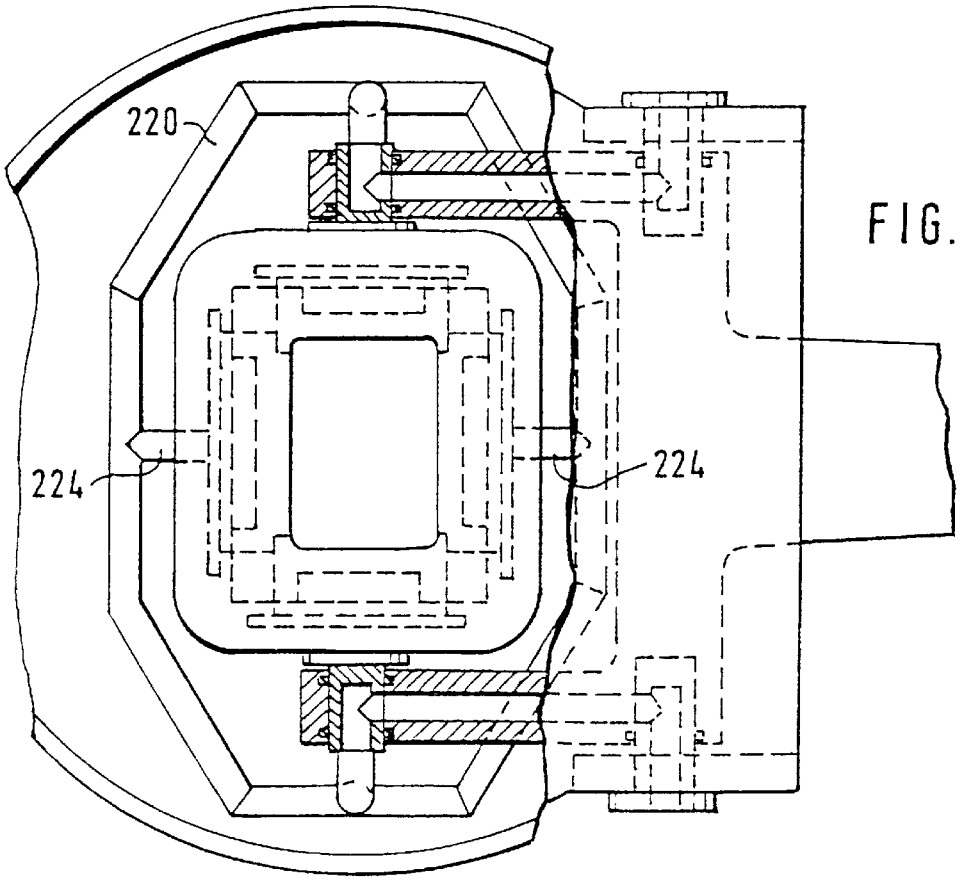
FIG. 18 shows a partial broken plan view of the mould shown in FIG. 17.

FIGS. 17 and 18 illustrate how the solution described above is applied to a mould with a plurality of separate cooling chambers 62. In this embodiment the swivel-mounted tubes 204' are joined in a torsionally strong manner to the framework. They run into a circumferential feed collector 222 or, as applicable, a circumferential return collector 220, which are also rigidly joined to the framework. Branch pipes 224 lead from these feed and return collectors into the individual cooling chambers 62.

It remains to be mentioned that all the moulds described can very easily be provided with an electromagnetic stirrer 300, as indicated in FIG. 5.

What is claimed is:

1. A continuous casting mould comprising:

several substantially rectangular mould plates with side faces and complementarily shaped longitudinal edges;

a self-supporting framework with lateral openings in which said mould plates are received so as to form a casting channel with an inlet opening and an outlet opening, said framework having:

an upper frame with an upper passage opening above said inlet opening of said casting channel, a lower frame with a lower passage opening below said outlet opening of said casting channel, and corner sections which join said upper frame to said lower frame, so that each of said lateral openings is bounded by border faces formed by a pair of corner sections and said upper and lower frames;

wherein said mould plates are fitted in said lateral openings of said framework so as to have their side faces in guiding contact with said border faces of said lateral openings and to be slidable in said lateral openings perpendicular to said casting channel until they positively engage with their complementarily shaped longitudinal edges to form said casting channel.

2. The mould according to claim 1, comprising fixing means acting on said mould plates so as to push the latter into said lateral openings of said framework.

3. The mould according to claim 1, wherein a circumferential O-ring is associated with said mould plate so as to seal said side faces of said mould plate against said border faces of said lateral opening in which said mould plate is received.

4. The mould according to claim 1, comprising a cover associated with said mould plate in such a way that at least one mould plate cooling chamber is formed between said mould plate and its associated cover.

5. The mould according to claim 4, wherein said cover is pushed with a front face on said mould plate.

6. The mould according to claim 4, wherein said cover is bolted and sealed onto said mould plate.

7. The mould according to claim 1, comprising an external jacket that surrounds said framework and butts in a sealed manner against said upper frame and said lower frame, wherein a cooling chamber is formed between said external jacket and said framework with said mould plates.

8. The mould according to claim 1, comprising an oscillator and a supporting structure, said supporting structure bearing said oscillator and said oscillator bearing said framework.

9. The mould according to claim 8, wherein said oscillator comprises an oscillating lever which is supported in an articulated manner by said supporting structure and is joined in an articulated manner to said framework.

10. The mould according to claim 9, defining a curved casting channel for casting a strand along a curved line having a center of curvature, said mould comprising:

a guide member which is joined in an articulated manner to said supporting structure and said framework, wherein a straight line through the articulations between said oscillating lever and said framework and between said oscillating lever and said supporting structure, on the one hand, and a straight line through the articulations between said guide member and said framework and between said guide member and said supporting structure, on the other hand, intersect in said center of curvature.

11. The mould according to claim 8 comprising:

a cooling box surrounding said framework with said mould plates;

an upper and a lower elastically deformable sealing membrane connecting said framework to said cooling box in such a way that a ring-shaped coolant chamber is delimited around said framework and said framework is capable of oscillating relative to said cooling box.

12. The mould according to claim 11 comprising:

an internal sealing device dividing said ring-shaped chamber into a lower and an upper ring-shaped collector, these lower and upper ring-shaped collectors being connected to a coolant feed line and a coolant return line respectively.

13. The mould according to claim 12 comprising:

a water conducting jacket that surrounds said framework so as to delimit an annular gap all around said framework, said annular gap connecting said lower ring-shaped collector to said upper ring-shaped collector.

14. The mould according to claim 12, wherein:

a mould plate cooling chamber is associated with each of said mould plates, and said mould plate cooling chambers are each connected via at least one lower opening to said lower ring-shaped collector and via at least one upper opening to said upper ring-shaped collector.

15. The mould according to claim 11, wherein said elastically deformable sealing membranes are made of an elastomeric material with reinforcing plies.

16. The mould according to claim 15, wherein said elastically deformable sealing membranes are each provided with a circumferential bulge.

17. The mould according to claim 9, wherein:

a mould plate cooling chamber is associated with each of said mould plates, and said mould plate cooling chambers are supplied with cooling water via said oscillating lever.

18. The mould according to claim 8, wherein a mould plate cooling chamber is associated with each of said mould plates, and said mould plate cooling chambers are fed with a coolant via flexible feed and return connections.

19. The mould according to claim 18, wherein said flexible feed and return connections comprise swivel-mounted tubes.

20. The mould according to claim 18, wherein said flexible feed and return connections comprise rolling-bellows connectors made of an elastomeric material.

21. The mould according to claim 20, wherein said rolling-bellows connectors are fitted substantially parallel to the direction of oscillation.

22. The mould according to claim 18, wherein said flexible feed and return connections comprise a ring-shaped flexible collector which surrounds said framework and is formed by two ring-shaped membranes placed one above said other.

23. The mould according to claim 22, wherein said ring-shaped flexible collector is divided by partitions into a plurality of ring segments.

24. The mould according to claim 1, wherein:

a mould plate cooling chamber is associated with each of said mould plates, and said upper and lower frames are provided with connecting channels for a coolant, said channels running into said cooling chambers of said mould plates.

25. The mould according to claim 1, wherein:

a mould plate cooling chamber is associated with each of said mould plates, and said mould plates are provided with cooling fins in said mould plate cooling chambers.

26. The mould according to claim 1, wherein said mould plates are provided with internal channels for a coolant.

27. The mould according to claim 1, wherein said framework is provided with internal cooling channels for a coolant.

* * * * *